United States Patent [19]

Rosenoy

[11] Patent Number: 4,800,946

[45] Date of Patent: Jan. 31, 1989

[54] WINDSTRAP FOR PLIABLE ROLL-TYPE OVERHEAD DOOR

[75] Inventor: Anthony Rosenoy, Dubque, Iowa

[73] Assignee: Frommelt Industries, Inc., Dubuque, Iowa

[21] Appl. No.: 83,936

[22] Filed: Aug. 10, 1987

Related U.S. Application Data

[63] Continuation of Ser. No. 867,483, May 27, 1986, abandoned.

[51] Int. Cl.[4] ..... A47G 5/02

[52] U.S. Cl. ..... 160/264; 160/133

[58] Field of Search ..... 160/264, 265, 379, 133

[56] References Cited

U.S. PATENT DOCUMENTS

| | | | |
|---|---|---|---|
| 2,780,283 | 2/1957 | Wasserman | 160/264 X |
| 3,092,170 | 6/1963 | Ellis | 160/264 X |
| 3,180,401 | 4/1965 | Gambon et al. | 160/265 |
| 3,292,685 | 12/1966 | Clark | 160/264 X |
| 3,430,677 | 3/1969 | Pierce | 160/264 |
| 3,460,602 | 8/1969 | Hugus | 160/265 |
| 3,583,465 | 6/1971 | Youngs et al. | 160/264 |
| 3,750,740 | 8/1973 | Newman | 160/264 X |
| 3,878,879 | 4/1975 | Manns | 160/273 R |

*Primary Examiner*—Ramon S. Britts
*Assistant Examiner*—David M. Purol
*Attorney, Agent, or Firm*—Emrich & Dithmar

[57] ABSTRACT

A windstrap secured to a lightweight, pliable, roll-type overhead door across the width thereof reinforces the door structure maintaining it in position across a doorway when the door is in the lowered, extended position and isolating the two areas on respective sides of the door when there is a pressure differential therebetween such as due to wind.

5 Claims, 3 Drawing Sheets

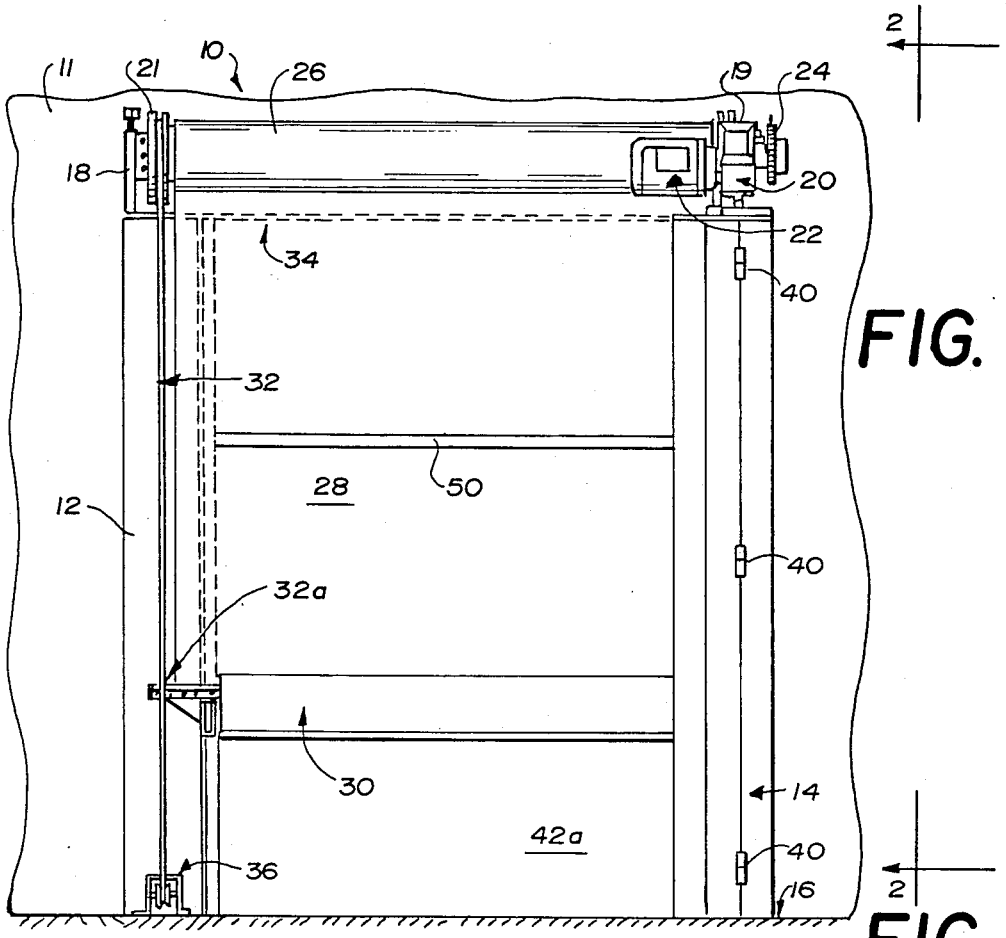
FIG. 1
FIG. 2
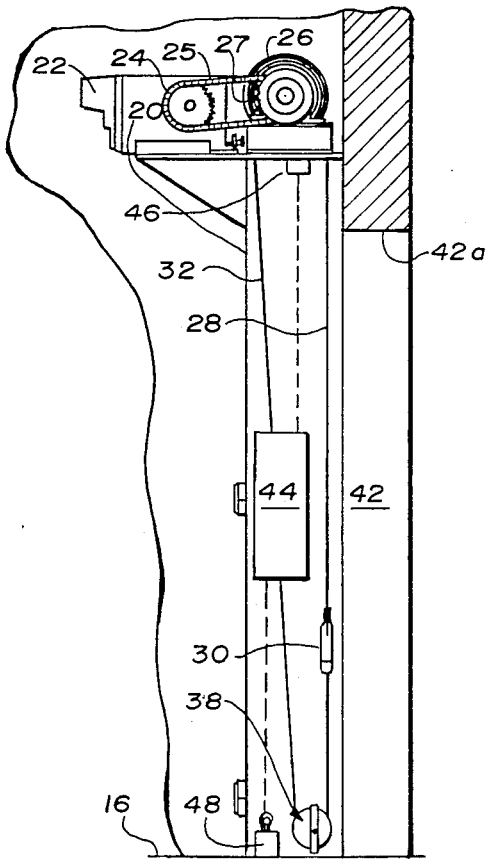
FIG. 3
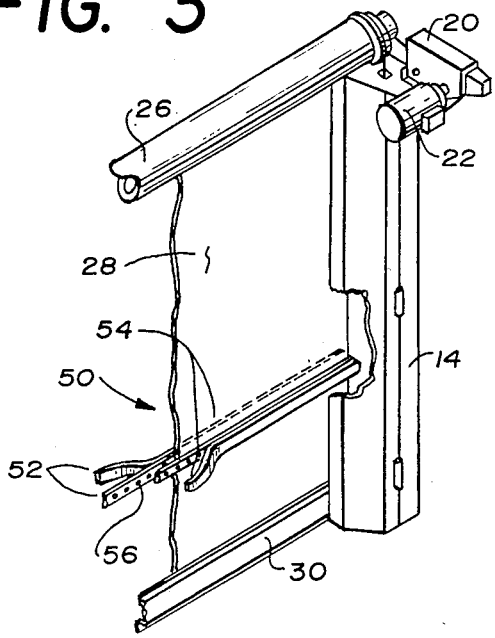

WINDSTRAP FOR PLIABLE ROLL-TYPE OVERHEAD DOOR

This is a continuation of application Ser. No. 867,483, filed May 27, 1986, now abandoned.

BACKGROUND OF THE INVENTION

This invention relates generally to flexible door structures and is particularly directed to lightweight, pliable roll-type overhead doors.

Roll-type doors are frequently used in industrial installations to isolate two rooms or the inside of a building from the outside environment while permitting transit between the two rooms or either out of or into the building as desired. These roll-type doors are generally mounted on a pair of vertically aligned tracks and are securely coupled at an upper end portion thereof to a roller which is rotated in a first direction to lower the door or in a second direction to retract the door. The roller is typically mounted immediately above the doorway and generally includes an electric motor for rotationally displacing the roller. Doors of this type have generally been comprised of a plurality of rigid hingedly interconnected metal panels which can be wrapped around the roller when retracted for storage while providing a rigid door structure of high strength when lowered in position in the doorway.

Recent developments in the area of roll-type doors have given rise to another type of door comprised of a pliable sheet-like structure which frequently is transparent and is adapted for rapid displacement between the retracted, rolled up configuration and the lowered, extended configuration. These doors are typically comprised of a high strength plastic material such as polyvinyl chloride only limited success in maintaining the door in a laterally stretched condition so that it remains extended from one side of the doorway to the other. The absence of lateral rigidifying means in existing pliable, lightweight roll-type doors has limited their usefulness in environments where wind is a factor or where a large pressure differential exists between the two rooms separated by the door.

Some prior art doors of this type incorporate trolleys coupled to respective lateral-edge portions of the pliable door which are mounted in and displaceable within respective tracks positioned adjacent to lateral portions of the door. While this trolley/track arrangement maintains the pliable door laterally taut, such arrangements substantially increase the complexity and cost of the door installation.

The present invention overcomes the limitations of the prior art by providing structural means for maintaining a lightweight, pliable, roll-type door in a laterally stretched condition across a doorway without the use of a trolley/track combination. The present invention contemplates one or more windstraps positioned in spaced relation along the length of the door and extending substantially the width thereof so as to maintain the door generally flat even when subjected to lateral loading on one surface thereof such as due to wind or a pressure differential. (PVC) and may be displaced from the open to the closed position, or vice versa, in just a few seconds. As this type of door lacks the structural strength of the aforementioned multi-section hinged roll-type door, roll-type doors comprised of a single pliable sheet-like member are intended primarily for environmentally isolating two adjacent rooms or the inside of a building from the environment outside rather than for providing security by preventing transit through a doorway. A rapidly displaced overhead roll-type door having good insulating characteristics is particularly desirable from an energy conservation standpoint where there is a large differential between inside and outside temperatures.

A primary difference between the single sheet, pliable roll-type doors and the aforementioned multi-section, hingedly interconnected rigid roll-type doors is that the former require tensioning means coupled to the lower end portion of the door in order to maintain the door in a taut condition so as to prevent lateral displacement of the door, while in the latter installation the considerable weight of the door maintains the door in a planar configuration during raising and lowering. Pliable roll-type door tensioning arrangements typically include various combinations of springs, pulleys and weights to exert a downward force on the lower edge portion of the door so as to maintain it generally planar across the doorway when it is extended. Thus, while the prior art has provided for stretching pliable overhead roll-type doors in a generally vertical direction to maintain the door in a flat configuration, prior art approaches have met with

OBJECTS AND SUMMARY OF THE INVENTION

Accordingly, it is an object of the present invention to provide an improved lightweight, pliable, roll-type overhead door.

It is another object of the present invention to provide reinforcement for an overhead roll-type door which is lightweight, allows the door to be tightly rolled up, and permits the door to remain in position across a doorway even under high wind loads.

Yet another object of the present invention is to provide a windstrap for a pliable roll-type overhead door which is lightweight, easily installed, can be retrofit on existing doors, and does not interfere with the rapid rolling up and unrolling of the door.

The present invention contemplates a windstrap for a pliable roll-type overhead door which permits the door to withstand wind and other forms of loading while remaining in position across an opening in isolating the areas on each side of the door. The windstrap includes a pair of metal straps mounted to respective opposing surfaces of the door and mutually coupled by a plurality of spaced rivets inserted therethrough. Positioned along the length of each strap is a respective anti-friction pad for protecting the door, which typically is comprised of a transparent plastic, from damage and wear by the mounting rivets during the retraction/extension of the door. More than one windstrap may be positioned on the door to accommodate increased door loading, with the windstraps positioned on the door so as to be generally equally spaced along the length of the door when extended and equally spaced around the roller from a pressure strap coupling the upper end of the door to the roller when the door is rolled up.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a front plan view of a roll-type overhead door having a windstrap thereon in accordance with the present invention;

FIG 2 is a lateral view of a roll-type overhead door assembly of FIG. 1 taken along sight line 2—2 therein;

FIG. 3 is a partial perspective view of a windstrap installation for a pliable roll-type overhead door in accordance with the present invention;

DETAILED DESCRIPTION OF THE PREFERRED EMBODIMENT

Figure 4:
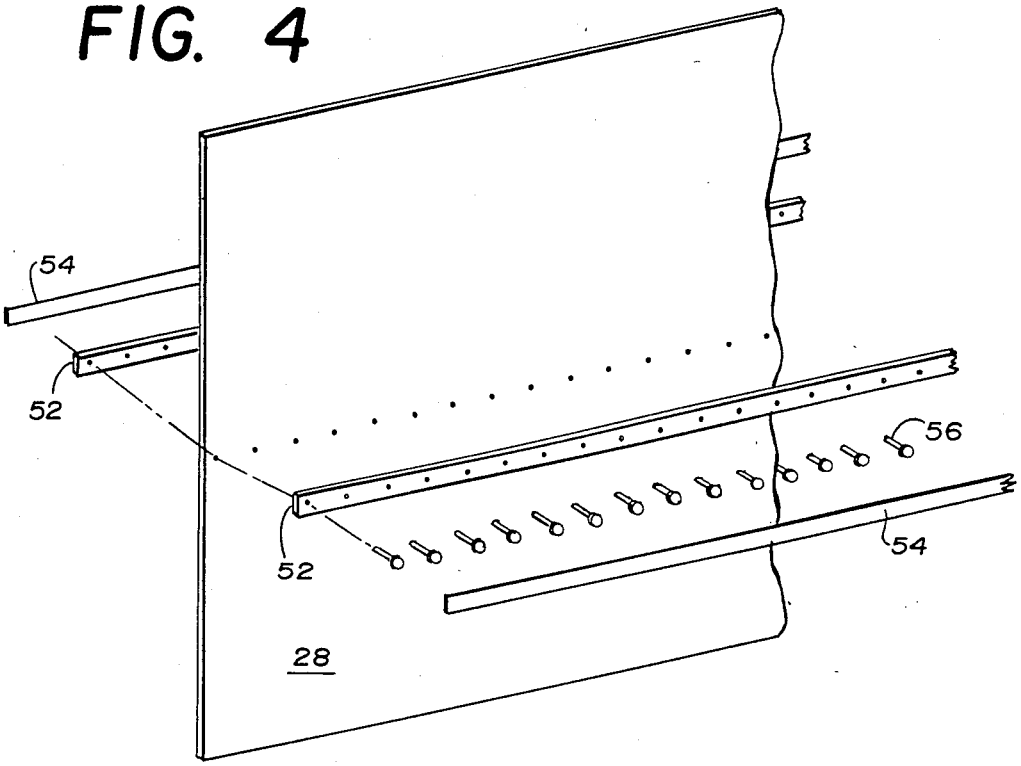
FIG. 4 is an exploded perspective view of a windstrap for a pliable roll-type overhead door of the present invention showing the installation thereof on the door.

Referring to FIGS. 1 and 2, there are respectively shown front and lateral views of a roll-type overhead door assembly 10 in which the windstrap 50 of the present invention is intended for use.

The roll-type overhead door assembly 10 is adapted for secure mounting to a wall 42 about an aperture, or doorway, 42*a* therein. The overhead door assembly 10 includes left and right housings 12, 14 which are generally vertically oriented and are positioned upon a support surface, or floor, 16 immediately adjacent to respective lateral portions of the doorway 42*a* within the wall 42. Securely mounted to respective upper end portions of the left and right housings 12, 14 are left and right mounting brackets 18, 19. Positioned between and supported by the left and right mounting brackets 18, 19 is a door roller 26 which is freely rotatable within the mounting brackets. Positioned immediately adjacent to the right mounting bracket 19 on the upper end portion of the right housing 14 is the combination of a gear box 20 and an electric motor 22. The gear box 20 includes a drive sprocket 24 coupled thereto which, in turn, is coupled by means of a drive belt 25 to a roller sprocket 27 mounted on one end of the door roller 26. Actuation of the electric motor 22 results in rotational displacement of the drive sprocket 24 via the gear box 20 causing the rotational displacement of the combination of the roller sprocket 27 and the door roller 26. With a rolling door, or curtain, 28 mounted to and supported by the door roller 26, rotation of the door roller in a first direction results in a lowering of the door to an extended, closed position, while rotation of the door roller in a second direction results in a raising of the door to a retracted, stored position.

Positioned on respective ends of the door roller 26 immediately adjacent to the left and right mounting brackets 18, 19 is a take-up pulley 21. For simplicity, only the left take-up pulley 21 is shown in FIG. 1. A reinforced belting, or cable, 32 is attached to and disposed around each of the take-up pulleys 21. Each of the cables 32 is suspended downward from an associated take-up pulley 21 and is routed via a respective pulley 36 within an associated lateral housing to permit a second end 32*a* of each of the cables to be securely coupled to respective lateral portions of a bottom rail 30 of the rolling door 28. The bottom rail 30 is securely coupled to and integral with the lower end portion of the rolling door 28.

The overhead door assembly 10 further includes a door tension/counterbalancing mechanism 44 which may be coupled to one or both of the left and right cables 32. The door tension/counterbalancing mechanism 44 may be conventional in design and operation and typically includes various combinations of springs, pulleys, and weights designed to exert a downward, pulling force on the bottom rail 30 of the rolling door 28 in order to maintain the door in a stretched, flat configuration when positioned across the doorway 42*a* within the wall 42. Because the particular arrangement employed for exerting tension or a counterbalancing force upon the rolling door to maintain it in a vertically stretched condition does not form a part of the present invention, further details thereof are not provided herein. For simplicity, the door tension/counterbalancing mechanism 44 is merely shown as a block in FIG. 2 and may be coupled to either an upper mounting bracket 46 or a lower mounting bracket 48 within the right housing 14, or may be coupled to both mounting brackets. A similar arrangement may be provided in the left housing 12 for exerting a downward force on the lower left edge portion of the rolling door 28. Each of the left and right housings 12, 14 may be provided with the combination of a movable front panel and a plurality of hinges 40 to provide access to the cable and pulley or weight arrangement within the housing. Finally, a weather seal 34 is typically provided in an upper portion of the overhead door assembly 10 to maintain sealed engagement between the door assembly and the wall 42 immediately adjacent to the aperture 42*a* within the wall.

As shown in FIG. 1, a generally horizontally oriented windstrap 50 is positioned upon the rolling door 28 and extends substantially the width thereof. Similarly, exploded perspective views of a windstrap 50 for use with a roll-type overhead door 28 in accordance with the present invention are shown in FIGS. 3 and 4. The windstrap 50 includes a pair of elongated, linear straps 52 preferably comprised of stainless steel positioned on respective, opposing surfaces of the rolling door 28. The straps 52 are coupled and maintained in position by means of a plurality of coupling pins such as rivets 56 inserted in paired apertures in each of the straps along the lengths thereof. The rolling door 28 is also provided with a linear array of apertures therein positioned between the spaced straps 52 for allowing the insertion of the rivets therethrough. Positioned over each of the outer surfaces of the straps 52 is a respective anti-friction pad 54 which protects the rolling door 28 from abrasion and tearing when the door engages the windstrap 50 when in the rolled-up configuration. In a preferred embodiment, each of the anti-friction pads is comprised of a self-adhering loop of Velcro material positioned on a respective strap 52 along the length thereof. Similarly, in a preferred embodiment, the rolling door 28 is comprised of a transparent polyvinyl chloride (PVC) material which affords both strength and flexibility.

Figure 5:
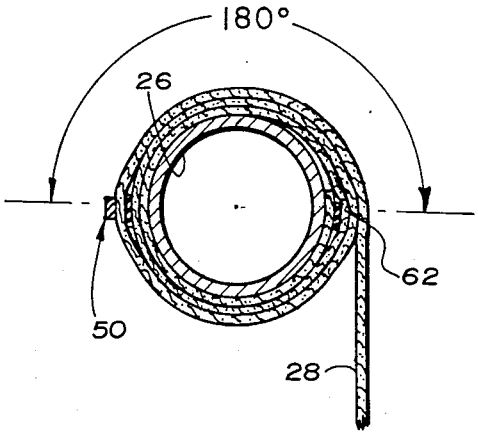
FIGS. 5 and 6 are lateral sectional views of rollers on which are rolled a pliable door in an overhead door installation wherein the doors respectively include one and two windstraps positioned thereon.
Figure 6:
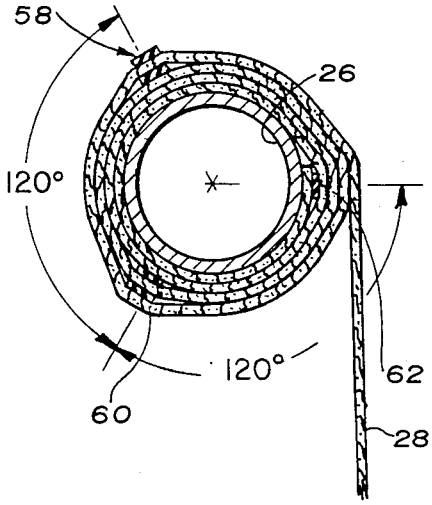

Referring to FIGS. 5 and 6, there are respectively shown sectional views of a door roller 26 around which is wound a rolling door 28. One end of the flexible door 28 is coupled to the outer, cylindrical surface of the door roller 26 by means of a pressure strap 62 positioned along the width of the rolling door and the length of the door roller. As shown in FIG. 5, the rolling door 28 is provided with a single windstrap 50. In this case, the windstrap 50 is located approximately midway between the bottom edge of the door and the door roller when fully extended and is positioned approximately 180° from a pressure strap 62 on the roller 26 when the door is rolled up. The pressure strap 62 securely couples the upper edge of the rolling door 28 along the width thereof to the door roller 26. The procedure for positioning of the pressure strap 62 is to initially mark the rolling door 28 with a line approximately one-half the height of the door when in the fully extended position. The rolling door 28 is then retracted upon the door roller 26 until the aforementioned marked line is positioned upon the roller, whereupon the line is then adjusted so as to be spaced approximately 180° from the position of the pressure strap 62 on the door roller 26.

As shown for the case of two windstraps 58, 60 positioned upon the rolling door 28 in FIG. 6, the rolling door is initially divided approximately into thirds and horizontal lines are marked thereon to show the approximate location of the equally spaced windstraps. The rolling door 28 is then retracted and wound around the door roller 26 until the aforementioned marked lines are positioned on the door roller. The two marked lines are then adjusted so as to be displaced approximately 120° in opposite directions from the pressure strap 62 on the door roller 26. Once the aforementioned lines are appropriately marked on the rolling door 28, the door is extended to the full open position and the windstrap (or windstraps) or windstraps are riveted to the rolling door as described above. By maintaining maximum angular displacement between the pressure strap 62 and the windstrap (or windstraps), overlapping of the windstrap and the pressure strap is prevented and the possibility of damage to the rolling door arising therefrom is eliminated. This also ensures that the rolling door is wound tightly on the door roller for maintaining the door in a taut configuration and ensuring that the rolling door is displaced upward and downward in a smooth, continuous manner.

There has thus been shown a pliable roll-type overhead door having a windstrap (or windstraps) positioned substantially along the width thereof for maintaining the door in a laterally stretched, taut configuration during the rolling up and unrolling of the door as well as when the door is in the extended position. The windstrap ensures that the pliable door remains in position over an aperture in a wall even when a pressure differential is applied across the door or when wind loading is imposed upon the door.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An improved roll-up door installation including a pliable door mounted at an upper end portion to a cylindrical roller having a generally circular uniform cross section along the length thereof, wherein said roller is coupled to drive means for rotationally displacing said roller in raising and lowering said door and wherein said pliable door is comprised of a transparent material subject to surface scratching resulting in its reduced transparency, said roll-up door installation further including tension means coupled to a lower end portion of said door for maintaining said door in a tightly stretched condition when removed from said roller, the improvement comprising:

strap means mounted to the door substantially across the width thereof for reinforcing and maintaining the door in a laterally stretched condition upon the application of a load thereto, wherein said strap means includes a pair of elongated, linear metal strips positioned directly opposite each other on respective opposing surfaces of the door and a plurality of mounting pins inserted therethrough maintaining said metal strips in position on the door; and first and second anti-friction wear pads secured on an outer surface of each of said metal strips for preventing contact between a metal strip and a portion of the roll-up door to which said metal strip is not mounted when the door is rolled up on the roller so as to avoid scratching of the pliable door and reducing its transparency.

2. The roll-up door installation of claim 1 wherein each of said metal strips is comprised of stainless steel and said mounting pins are rivets.

3. The roll-up door installation of claim 1 further including a pressure strap coupling an upper end portion of the roll-up door to the roller and wherein said strap means includes a pair of coupled metal strips mounted on respective, opposing surfaces of the door at approximately one-half the height of the door when fully extended and disposed approximately 80° from said pressure strap when the door is rolled up on the roller.

4. The roll-up door installation of claim 1 further including a pressure strap coupling an upper end portion of the roll-up door to the roller and a plurality of paired coupled metal strips each mounted on a respective, opposing surface of the door and wherein each pair of coupled metal strips is positioned along the length of the door in an approximately equally spaced manner and is angularly displaced an approximately equal angular distance around the roller from said pressure strap when the door is rolled up.

5. The roll-up door installation of claim 4 wherein said strap means includes two pairs of metal strips each positioned on the door approximately one-third the length of the door from a respective end thereof so as to divide the door into three approximately equal sections and wherein each pair of metal strips is displaced approximately 120° from said pressure strap and from the other pair of metal strips when the door is rolled up on the roller.

* * * * *

UNITED STATES PATENT AND TRADEMARK OFFICE

CERTIFICATE OF CORRECTION

PATENT NO. : 4,800,946

DATED : January 31, 1989

INVENTOR(S) : Anthony Rosenow

It is certified that error appears in the above—identified patent and that said Letters Patent is hereby corrected as shown below:

In the cover sheet, the inventor's name and post office address should be -- Anthony Rosenow, Dubuque, Iowa --.

Column 1, lines 36-62, the following text which appears thereat should be deleted therefrom and inserted at column 2, line 25, after "have met with":

--only limited success in maintaining the door in a laterally stretched condition so that it remains extended from one side of the doorway to the other. The absence of lateral rigidifying means in existing pliable, lightweight roll-type doors has limited their usefulness in environments where wind is a factor or where a large pressure differential exists between the two rooms separated by the door.

Some prior art doors of this type incorporate trolleys coupled to respective lateral edge portions of the pliable door which are mounted in and displaceable within respective tracks positioned adjacent to lateral portions of the door. While this trolley/track arrangement maintains the pliable door laterally taut, such arrangements substantially increase the complexity and cost of the door installation.

The present invention overcomes the limitations of the prior art by providing structural means for maintaining a lightweight, pliable, roll-type door in a laterally stretched condition across a doorway without the use of a trolley/track combination. The present invention contemplates one or more windstraps positioned in spaced

UNITED STATES PATENT AND TRADEMARK OFFICE

CERTIFICATE OF CORRECTION

PATENT NO. : 4,800,946

DATED : January 31, 1989

INVENTOR(S) : Anthony Rosenow

It is certified that error appears in the above-identified patent and that said Letters Patent is hereby corrected as shown below:

relation along the length of the door and extending substantially the width thereof so as to maintain the door generally flat even when subjected to lateral loading on one surface thereof such as due to wind or a pressure differential. --

Signed and Sealed this

Twenty-seventh Day of June, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,800,946

DATED : January 31, 1989

INVENTOR(S) : Anthony Rosenow

It is certified that error appears in the above-identified patent and that said Letters Patent is hereby corrected as shown below:

Col. 6, 7th Line of Claim 3:
"80°" should read --180°--

Signed and Sealed this

Second Day of July, 1991

*Attest:*

HARRY F. MANBECK, JR.

*Attesting Officer*

*Commissioner of Patents and Trademarks*